US012780278B2

(12) United States Patent
Bohme et al.

(10) Patent No.: US 12,780,278 B2
(45) Date of Patent: Nov. 3, 2026

(54) CROSSING GATE MECHANISM WITH INTEGRATED COVER OR DOOR DETECTION SCHEME

(71) Applicant: Siemens Mobility, Inc., New York, NY (US)

(72) Inventors: Richard C. Bohme, Louisville, KY (US); Brian D. Lawry, Murrysville, PA (US)

(73) Assignee: Siemens Mobility, Inc., New York, NY (US)

( * ) Notice: Subject to any disclaimer, the term of this patent is extended or adjusted under 35 U.S.C. 154(b) by 497 days.

(21) Appl. No.: 18/458,238

(22) Filed: Aug. 30, 2023

(65) Prior Publication Data

US 2023/0399038 A1 Dec. 14, 2023

Related U.S. Application Data

(63) Continuation-in-part of application No. 17/654,897, filed on Mar. 15, 2022, now Pat. No. 12,485,937.

(51) Int. Cl.
*B61L 29/22* (2006.01)

(52) U.S. Cl.
CPC ..... *B61L 29/22* (2013.01)

(58) Field of Classification Search
CPC .. B61L 5/06; B61L 29/00; B61L 29/08; B61L 29/22; B61L 29/28; B61L 27/53; H03K 17/9517
See application file for complete search history.

(56) References Cited

U.S. PATENT DOCUMENTS 1,285,460 A * 11/1918 Swanson ..... B61L 29/284 246/126
1,560,085 A * 11/1925 Harvey ..... B61L 29/226 246/128
1,595,154 A * 8/1926 Harrison ..... B61L 29/226 49/93
1,941,017 A * 12/1933 Monge ..... B61L 29/20 246/297
6,307,339 B1 * 10/2001 Yourist ..... B61L 29/08 318/266
7,836,830 B2 * 11/2010 Searancke ..... B61B 13/12 105/139
8,794,158 B2 * 8/2014 Huber ..... B61F 5/22 104/284
9,809,237 B2 * 11/2017 DeJarnatt ..... B61L 23/007
10,589,766 B2 * 3/2020 Wydotis ..... B61L 29/288
10,593,170 B2 * 3/2020 DiPoala ..... G08B 13/08
10,618,531 B2 * 4/2020 Deshpande ..... B61C 17/12
(Continued)

FOREIGN PATENT DOCUMENTS

CA 3119726 A1 * 5/2020 ..... B61L 29/04
JP H0815292 A * 1/1996
(Continued)

*Primary Examiner* — Jason C Smith

(57) ABSTRACT

A crossing gate mechanism includes an enclosure housing multiple components including a control unit configured to operate the crossing gate mechanism and associated crossing gate arm, wherein the enclosure comprises a base and a cover, the cover being moveable between multiple positions including an open position and a closed position, and a cover detection device configured to detect a position of the cover.

20 Claims, 8 Drawing Sheets

(56) References Cited

U.S. PATENT DOCUMENTS

| | | | | |
|---|---|---|---|---|
| 12,012,137 | B2 * | 6/2024 | Fox | G01J 1/44 |
| 12,038,049 | B2 * | 7/2024 | Bohme | F16C 43/02 |
| 12,065,180 | B2 * | 8/2024 | Bohme | B61L 29/04 |
| 12,065,181 | B2 * | 8/2024 | Spencer | B61L 29/04 |
| 12,095,401 | B2 * | 9/2024 | Reed | G01L 5/26 |
| 2002/0090259 | A1 * | 7/2002 | Crowley | E01F 15/003 404/6 |
| 2010/0031847 | A1 * | 2/2010 | Hahn | B60L 13/03 104/284 |
| 2023/0294748 | A1 * | 9/2023 | Bohme | B61L 5/06 246/114 A |
| 2023/0399038 | A1 * | 12/2023 | Bohme | B61L 27/53 |
| 2024/0059331 | A1 * | 2/2024 | Young | H02P 23/14 |

FOREIGN PATENT DOCUMENTS

| | | | | | |
|---|---|---|---|---|---|
| JP | 2011256682 | A | * | 12/2011 | |
| KR | 102511729 | B1 | * | 3/2023 | |
| KR | 20230123074 | A | * | 8/2023 | |
| WO | WO-2019162481 | A1 | * | 8/2019 | B60L 50/60 |

* cited by examiner

CROSSING GATE MECHANISM WITH INTEGRATED COVER OR DOOR DETECTION SCHEME

CROSS-REFERENCE TO RELATED APPLICATIONS

The present application is a continuation-in-part of U.S. patent application Ser. No. 17/654,897 filed Mar. 15, 2022, entitled "Crossing Gate Mechanism with Integrated Cover or Door Detection Scheme" which is incorporated herein by reference in its entirety.

BACKGROUND

1. Field

Aspects of the present disclosure generally relate to railroad crossing gates and crossing gate mechanisms, more particularly, to a crossing gate mechanism with integrated cover or door detection scheme.

2. Description of the Related Art

A railway crossing, also referred to as level crossing or grade crossing, is an intersection where a railway line crosses a road or path. To ensure safety of railway crossings, crossing control systems including signal control equipment are installed at railway crossings. Railroad signal control equipment includes for example a constant warning time device, also referred to as a grade crossing predictor (GCP) in the U.S. or a level crossing predictor in the U.K., which is an electronic device that is connected to rails of a railroad track and is configured to detect the presence of an approaching train and determine its speed and distance from a crossing, i.e., a location at which the tracks cross a road, sidewalk or other surface used by moving objects. The constant warning time device will use this information to generate a constant warning time signal for a crossing warning device.

A crossing warning device is a device that warns of the approach of a train at a crossing, examples of which include crossing gate arms, crossing lights (such as the red flashing lights often found at highway grade crossings in conjunction with the crossing gate arms), and/or crossing bells or other audio alarm devices. Constant warning time devices are typically configured to activate the crossing warning device(s) at a fixed time, also referred to as warning time (WT), which can be for example 30 seconds, prior to the approaching train arriving at the crossing.

Railroad crossing gates utilize electrical and mechanical components to ensure that the crossing gates perform their intended functions correctly. For example, gate arms are lowered using a motor located in a crossing gate mechanism, herein also referred to as gate control mechanism. A crossing gate mechanism may be described as gate control box housing multiple electric and electronic components for operating and controlling the signal control equipment and warning devices, such as the crossing gates. Typically, the gate control box includes a housing with a cover or door, so that the control box may be opened for maintenance or other services.

SUMMARY

Briefly described, aspects of the present disclosure generally relate to railroad crossing gates and, more particularly to a crossing gate mechanism with integrated cover or door detection functionality.

An aspect of the present disclosure provides an enclosure housing multiple components including a control unit configured to operate the crossing gate mechanism and associated crossing gate arm, wherein the enclosure comprises a base and a cover, the cover being moveable between multiple positions including an open position and a closed position, and a cover detection device configured to detect a position of the cover.

Another aspect of the present disclosure provides a crossing gate system comprising one or more crossing gate arm(s), and a crossing gate mechanism comprising an enclosure housing multiple components including a control unit configured to operate the crossing gate mechanism and associated crossing gate arm, wherein the enclosure comprises a base and a cover, the cover being moveable between multiple positions including an open position and a closed position, and a cover detection device configured to detect a position of the cover.

DETAILED DESCRIPTION

To facilitate an understanding of embodiments, principles, and features of the present disclosure, they are explained hereinafter with reference to implementation in illustrative embodiments. In particular, they are described in the context of a crossing gate mechanism utilized in connection with railroad crossing gate applications.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
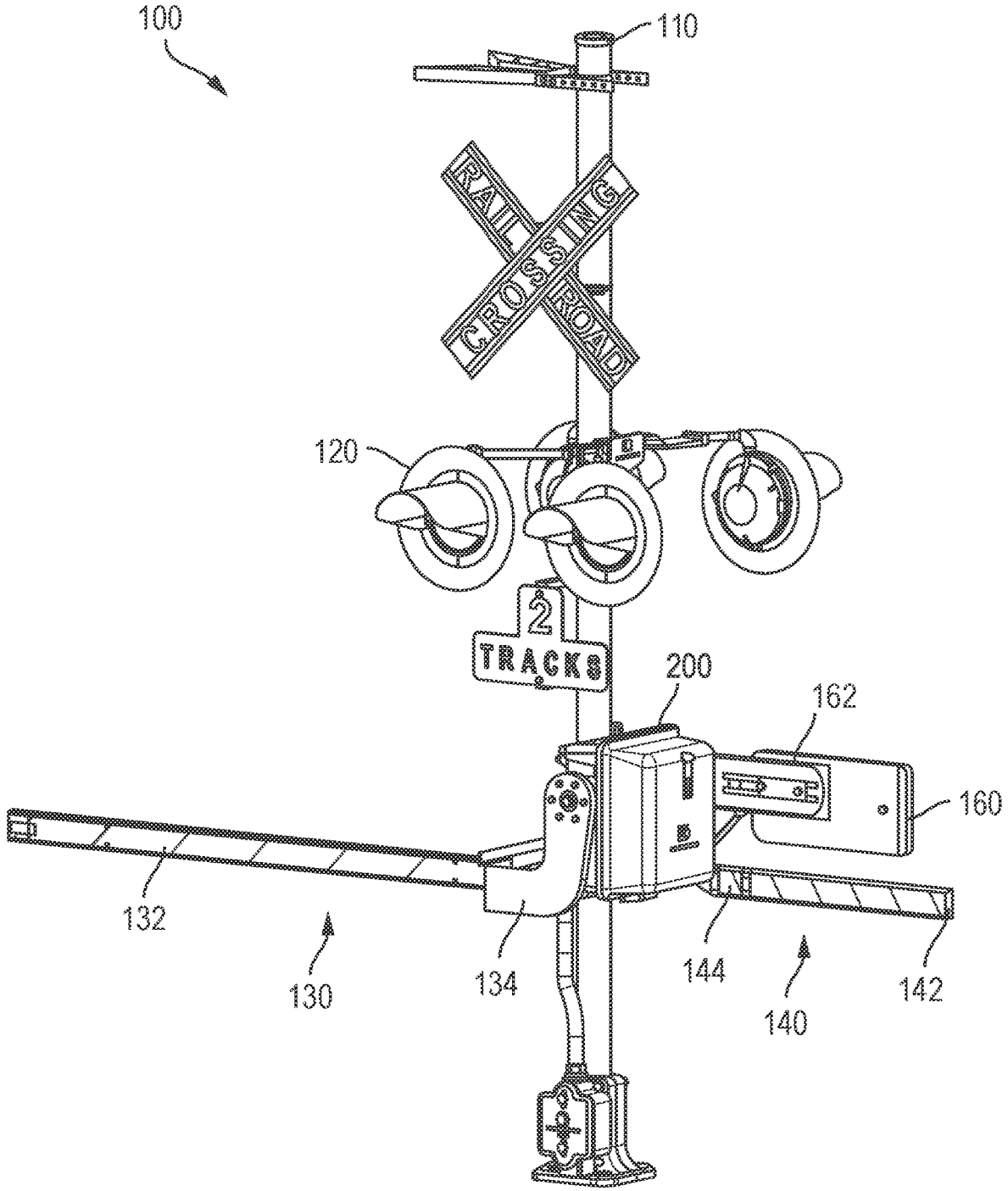
FIG. 1 illustrates an example railroad crossing gate in accordance with an exemplary embodiment of the present disclosure.

FIG. 1 illustrates a railroad crossing gate 100 in a lowered or horizontal position. At many railroad crossings, at least one railroad crossing gate 100 may be placed on either side of the railroad track to restrict roadway traffic in both directions. At some crossings, pedestrian paths or sidewalks may run parallel to the roadway. To restrict road and sidewalk traffic, the illustrated railroad crossing gate 100 includes a separate roadway gate 130 and pedestrian gate 140. The roadway gate 130 and pedestrian gate 140 may be raised and lowered, i.e., operated, by control mechanism 200.

The example railroad crossing gate 100 also includes a pole 110 and signal lights 120. The gate control mechanism 200 is attached to the pole 110 and is used to raise and lower the roadway and pedestrian gates 130, 140. The illustrated railroad crossing gate 100 is often referred to as a combined crossing gate. When a train approaches the crossing, the railroad crossing gate 100 may provide a visual warning using the signal lights 120. The gate control mechanism 200 will lower the roadway gate 130 and the pedestrian gate 140 to respectively restrict traffic and pedestrians from crossing the track until the train has passed.

As shown in FIG. 1, the roadway gate 130 comprises a roadway gate support arm 134 that attaches a roadway gate arm 132 to the gate control mechanism 200. Similarly, the pedestrian gate 140 comprises a pedestrian gate support arm 144 connecting a pedestrian gate arm 142 to the gate control mechanism 200. When raised, the gates 130 and 140 are positioned so that they do not interfere with either roadway or pedestrian traffic. This position is often referred to as the vertical position. A counterweight 160 is connected to a counterweight support arm 162 connected to the gate control mechanism 200 to counterbalance the roadway gate arm 132. Although not shown, a long counterweight support arm could be provided in place of the short counterweight support arm 134.

Typically, the gates 130, 140 are lowered from the vertical position using an electric motor contained within the gate control mechanism 200. The electric motor drives gearing connected to shafts (not shown) connected to the roadway gate support arm 134 and pedestrian gate support arm 144. The support arms 134, 144 are usually driven part of the way down by the motor (e.g., somewhere between 70 and 45 degrees) and then gravity and momentum are allowed to bring the arms 132, 142 and the support arms 134, 144 to the horizontal position. In another example, the support arms 134, 144 are driven all the way down to the horizontal position by the electric motor of the gate control mechanism 200.

Figure 2:
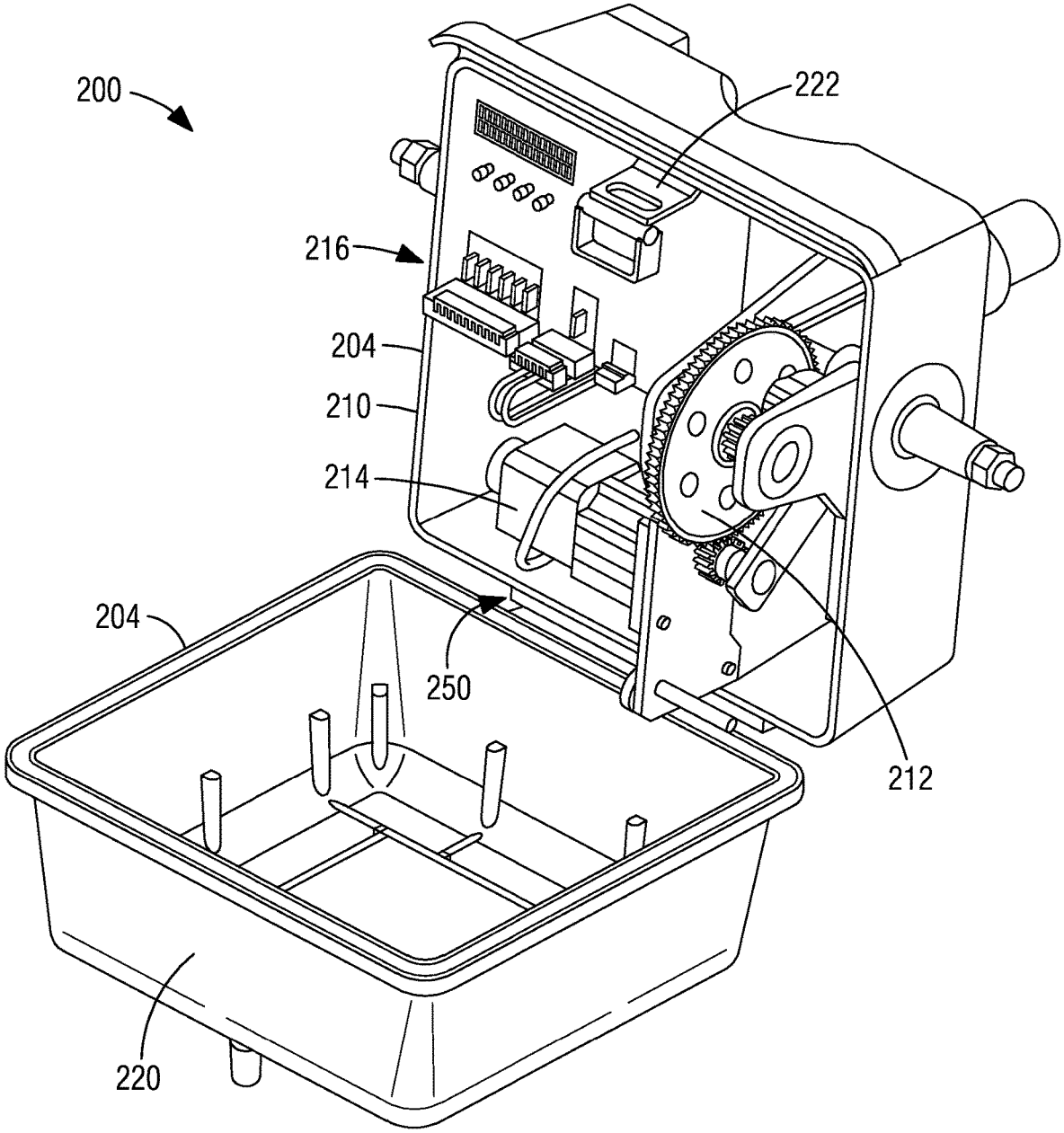
FIG. 2 illustrates a perspective view of a crossing gate mechanism in accordance with an exemplary embodiment of the present disclosure.

FIG. 2 illustrates a perspective view of crossing gate mechanism 200 in accordance with an exemplary embodiment of the present disclosure.

In general, the crossing gate mechanism 200 comprises an enclosure 204 housing multiple mechanical, electrical, and electronic components such as for example gearing 212, electric motor 214 driving the gearing 212, and control unit 216 configured to operate the crossing gate mechanism 200 and associated crossing gate arm (see FIG. 1). The enclosure 204 comprises a base 210 and a cover 220. The enclosure 210 can be opened and closed via door or cover 220, for maintenance, repair, or other services. The cover 220 is moveable between multiple positions including an open position and a closed position. FIG. 2 shows the cover 220 in the open position. The cover 220 is closed via hinge 250 and latch plate 222 in connection with a latch rod (not shown). The base 210 is the component that houses most of the components of the crossing gate mechanism 200 and is mounted at the post or pole 110 (see FIG. 1).

Currently, crossing gate mechanisms 200, sometimes also referred to as crossing gate box or grade control box, do not have a functionality that indicates whether the cover 220 is open or closed. Such a functionality or mechanism allows determination, for example by other railway equipment or railway personnel at another location, whether the cover 220 is in the correct state, for example closed when it is supposed to be closed, or open, for example when the crossing gate mechanism 200 is being serviced. If the cover 220 is not in the correct state, the control box 200 may be subject to vandalism or may have not been closed properly, wherein service personnel can then address this issue.

Thus, in an exemplary embodiment of the present disclosure, the crossing gate mechanism 200 comprises a cover detection device that is configured to detect, indicate, or identify and log or record a position of the cover 220. Further, the crossing gate mechanism 200 is configured to notify other train control systems or device with respect to the position of the cover 220. More specifically, the cover detection device is configured to detect, indicate or identify and log or record when the cover 220 is in a position, which can be a closed position and an open position. A 'closed position' of the cover 220 means that the cover 220 is adjacent to the base 210 and 100% closed, and in a 0% open position. All other positions that are not completely (100%) closed are referred to as an 'open position' of the cover 220. For example, if the cover 220 is only slightly open, for example 5% open, it means that the cover 220 is in the open position. Also, if the cover 220 is completely open (100% open), the cover is in the open position.

Figure 3C:
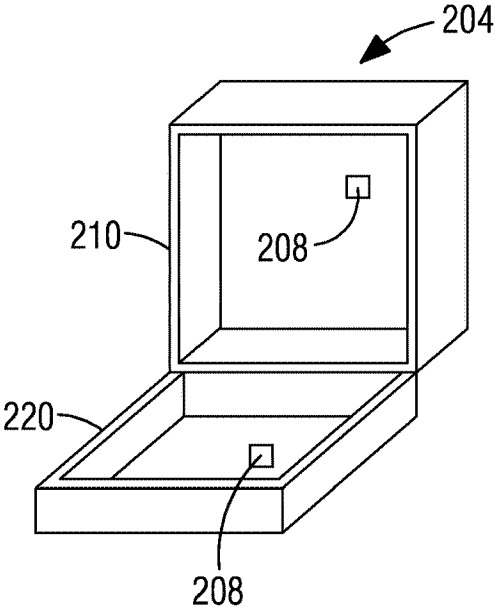
FIG. 3A, FIG. 3B and FIG. 3C illustrate simplistic schematics of an enclosure of a crossing gate mechanism including cover detection device in accordance with exemplary embodiments of the present disclosure.
Figure 3B:
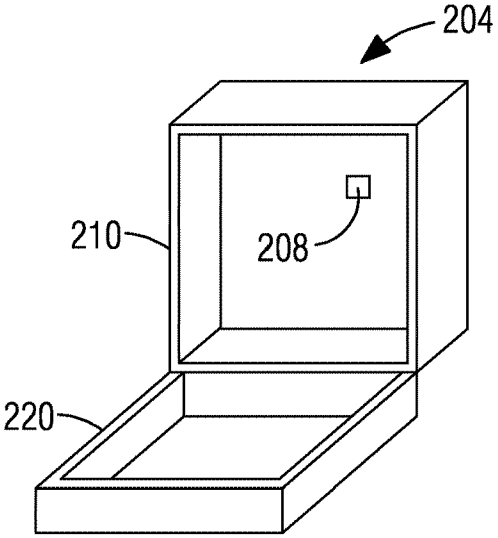
Figure 3A:
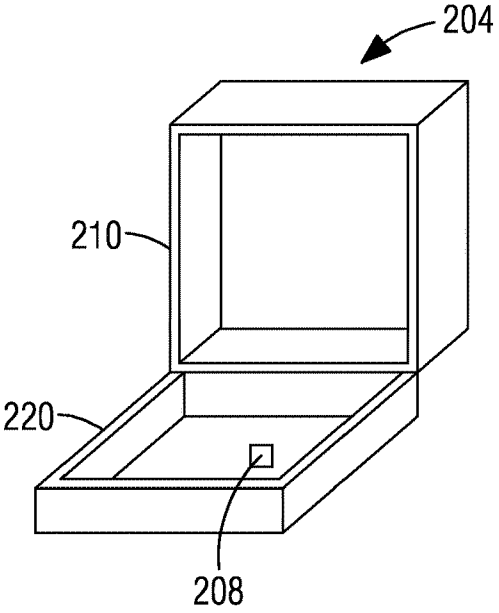

FIG. 3A, FIG. 3B and FIG. 3C illustrate simplistic schematics of an enclosure 204 of a crossing gate mechanism 200 including cover detection device in accordance with exemplary embodiments of the present disclosure.

The crossing gate mechanism 200 comprises enclosure 204 including base 210 and cover 220, wherein the cover 220 can be opened and closed to provide access to the components housed within the enclosure 204. The cover 220 is shown in the open position. As noted, the gate mechanism 200 comprises a cover detection device 208 that is configured to detect a position of the cover 220, including an open position and a closed position of the cover 220. The cover detection device 208 may herein also referred to as "sensor" 208.

The sensor 208 can be arranged on different components of the mechanism 200. With reference to FIG. 3A, in an example, the sensor 208 is arranged on the cover 220. In another example, with reference to FIG. 3B, the sensor 208 is arranged on the base 210. In yet another example, with reference to FIG. 3C, the sensor 208 is arranged on both the base 210 as well as the cover 220. This means that the cover detection device 208 may comprise multiple components, wherein certain components are arranged on the cover 220, while other components may be arranged on the base 210.

In another embodiment, the gate mechanism 200 comprises multiple sensors 208 configured to detect the position of the cover 220, wherein the multiple sensors 208 can be arranged solely on the cover 220, solely on the base 210, or a combination of the cover 220 and the base 210.

Figure 4:
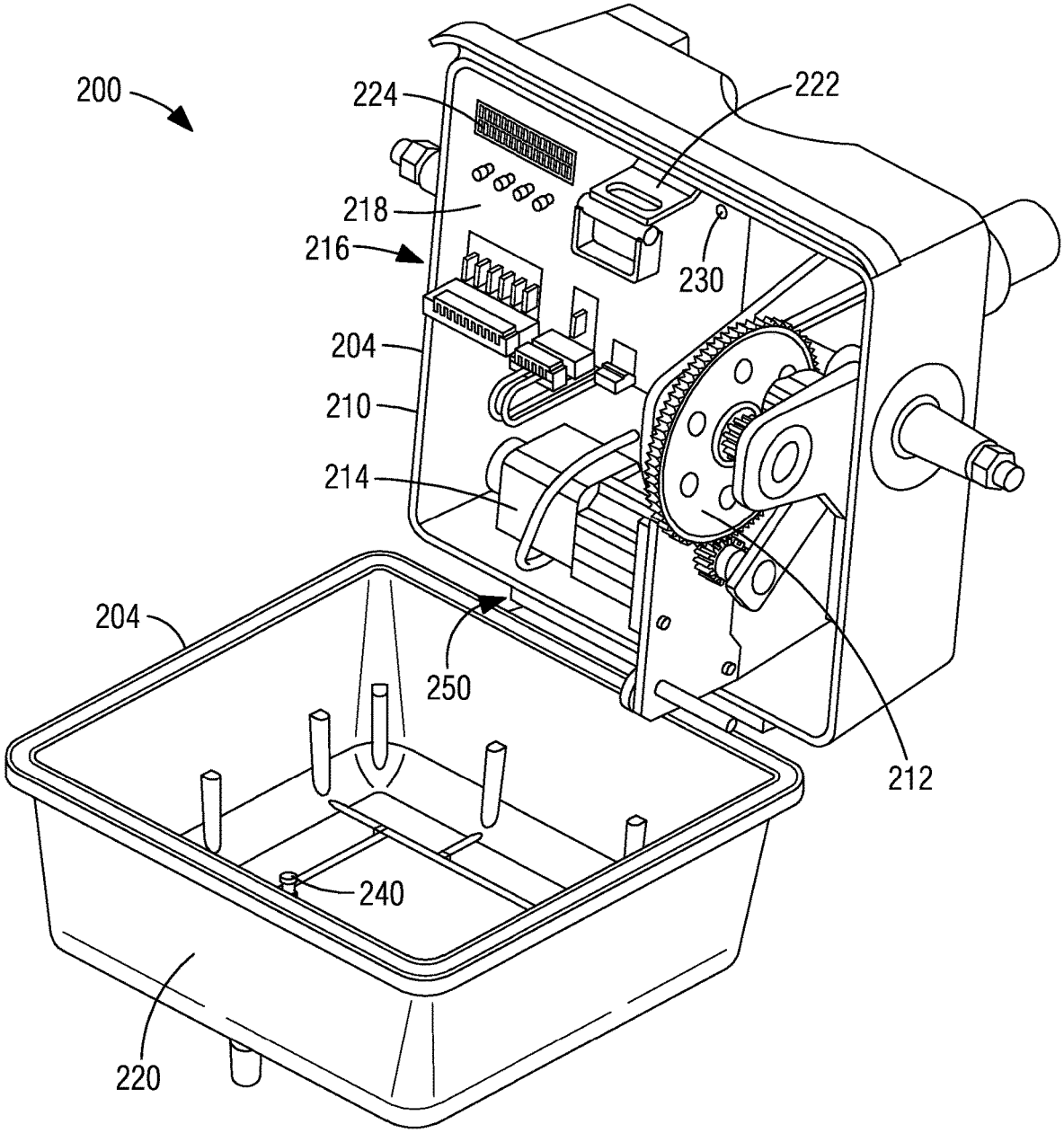
FIG. 4 illustrates a perspective view of an exemplary embodiment of a crossing gate mechanism including cover detection device in accordance with an exemplary embodiment of the present disclosure.

FIG. 4 illustrates a perspective view of an exemplary embodiment of a crossing gate mechanism 200 including cover detection device 208 in accordance with an exemplary embodiment of the present disclosure.

The crossing gate mechanism 200 comprises enclosure 204 with base 210 and cover 220, housing multiple mechanical, electric and electronic components, such as for example gearing 212, electric motor 214 driving the gearing 212, and control unit 216. The control unit 216 comprises a computing platform 218, which can comprise a printed circuit board (PCB), with the necessary electronics for operating and controlling the gate mechanism 200 and associated crossing gate equipment, such as crossing gate arm(s), see for example FIG. 1. Further, the computing platform 218 comprises for example display(s) and/or light emitting diodes (LEDs) 224, used for example to indicate or display status of the gate mechanism 200, such status including for example 'Power on', 'Gate Request', 'Brake On', 'Health' etc.

The enclosure 210 can be opened and closed via door or cover 220, for maintenance, repair, or other services. The cover 220 is moveable between multiple positions including a closed position and an open position, wherein FIG. 2 shows the cover 220 in the open position. The cover 220 is closed via hinge 250 and latch plate 222 in connection with a latch rod (not shown).

In an exemplary embodiment of the present disclosure, the crossing gate mechanism 200 comprises a cover detection feature or function that provides feedback with respect to a position of the cover 220, for example when the cover 220 is in the closed position or in the open position.

One of the multiple components positioned in the enclosure 210 is at least one sensing device 230, and the cover 220 comprises a detectable device 240. The detectable device 240 is arranged in the cover 220 such that, when the cover 220 is moved into the closed position, the detectable device 240 comes in proximity to the sensing device 230, which is then activated and configured to indicate that the cover 220 is in the closed position.

In an embodiment, the combination of the sensing device 230 and the detectable device 240 operate based on a magnetic field principle. The sensing device 230 detects presence of a magnetic field. In an example, the sensing device 230 comprises one or more sensor(s), for example Hall sensor(s), specifically a Hall sensor array. The detectable device 240 comprises a magnetized area with a magnetic field detectable by the sensing device 230, such as the Hall sensor array. The sensing device 230 may be arranged on the computing platform 218. However, it should be noted that the sensing device 230, for example Hall sensor array, may not be arranged on the computing platform 218, but in another location within the enclosure 204 of the crossing gate mechanism 200. The detectable device 240, herein also referred to as magnetized device 240, can be configured as a bolt or pin, for example a magnetized bolt or pin. In an embodiment, the magnetized device 240 comprises a magnetized area in a head of the bolt or pin.

In other embodiments, the sensing device 230 and detectable device 240 may not operate based on the magnetic field principle, but on different principles or modes. For example, the two devices 230, 240 may function together based on electrical or mechanical principles. The detectable device 240 provides a certain output or characteristic which is detectable or measurable by the sensing device 230.

Figure 5:
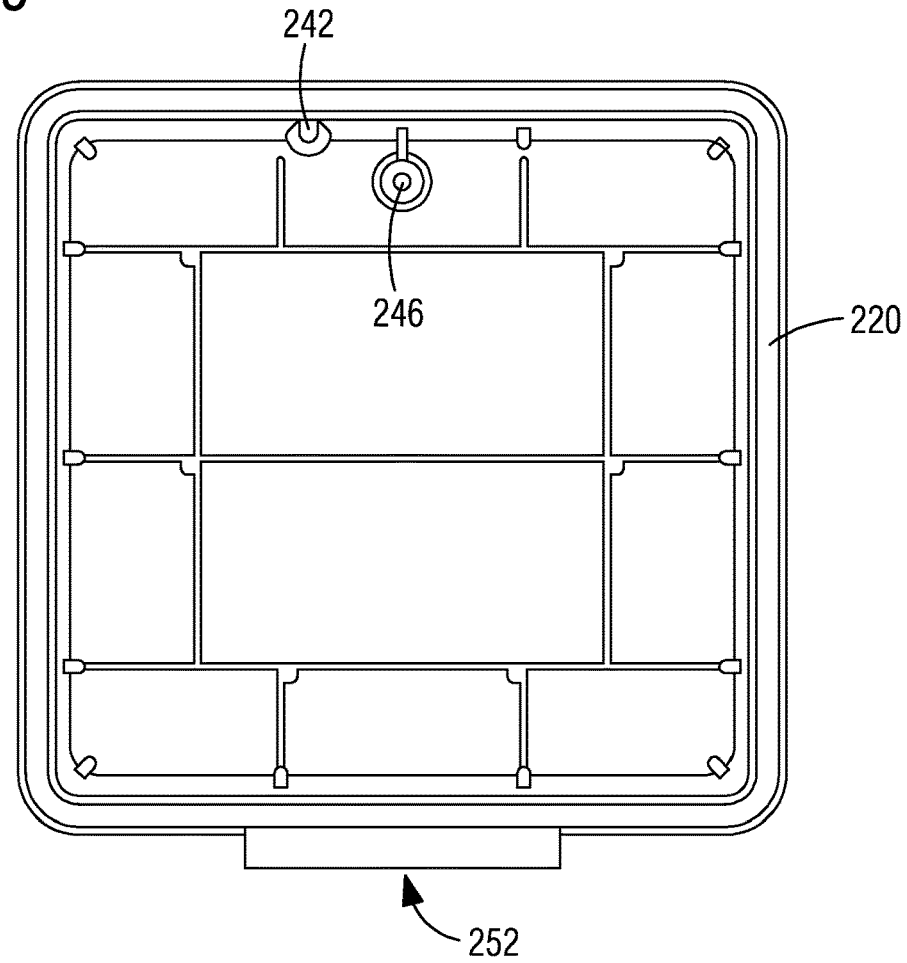
FIG. 5 and FIG. 6 illustrate different views of the cover in accordance with exemplary embodiments of the present disclosure.
Figure 6:
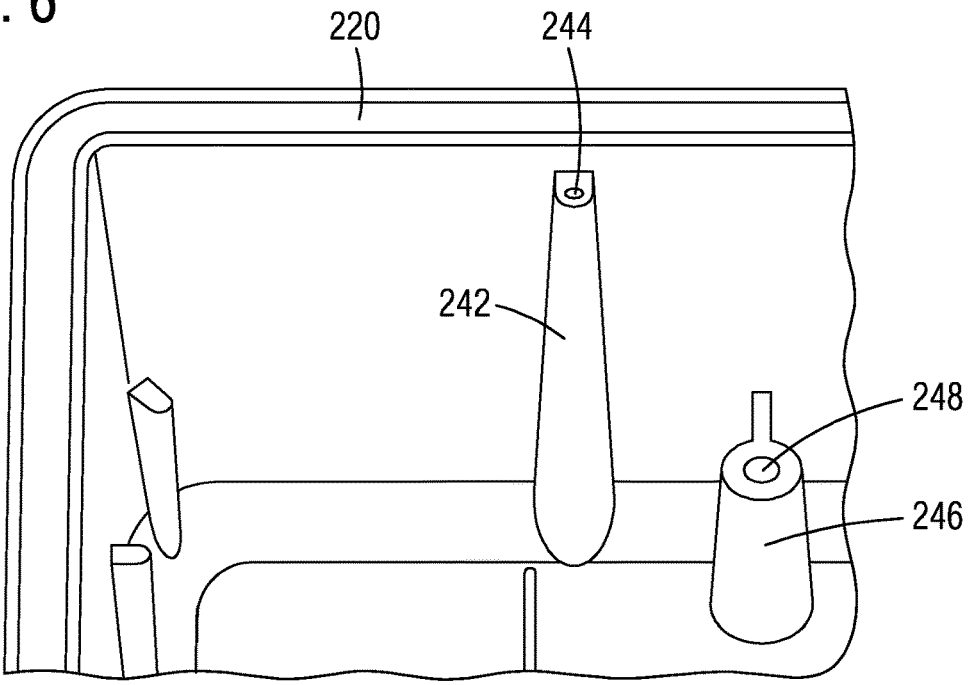

FIG. 5 and FIG. 6 illustrate different views of the cover 220 of the embodiment shown in FIG. 4 in accordance with exemplary embodiments of the present disclosure.

FIG. 5 illustrates a view of a 'raw' cover 220, specifically an inside of the cover 220. 'Raw' means that the cover 220 is shown in a manufacturing state, without being further processed (machined) into its final state. The cover 220 as well as the housing 210 are manufactured from metal, such as for example aluminum castings. When manufactured, the cover 220 includes protruding feature or raised boss 242 for receiving the magnetized device 240, and feature 246 for receiving a hatch rod (not shown) that is used for closing and securely connecting the cover 220 to the enclosure 210. Further, hinge area 252, including for example a hinge plate, is illustrated.

FIG. 6 illustrates a view of a section of a finalized cover 220, i.e., processed/machined into its final state. Raised boss 242 now comprises a threaded mounting hole 244 for inserting/receiving the magnetized device 240, e.g. magnetized bolt. Further, feature 246 comprises an opening/hole 248 for arranging a latch rod (not shown) to be operated with the latch plate 222 (see FIG. 1) of the enclosure 210.

Figure 7:
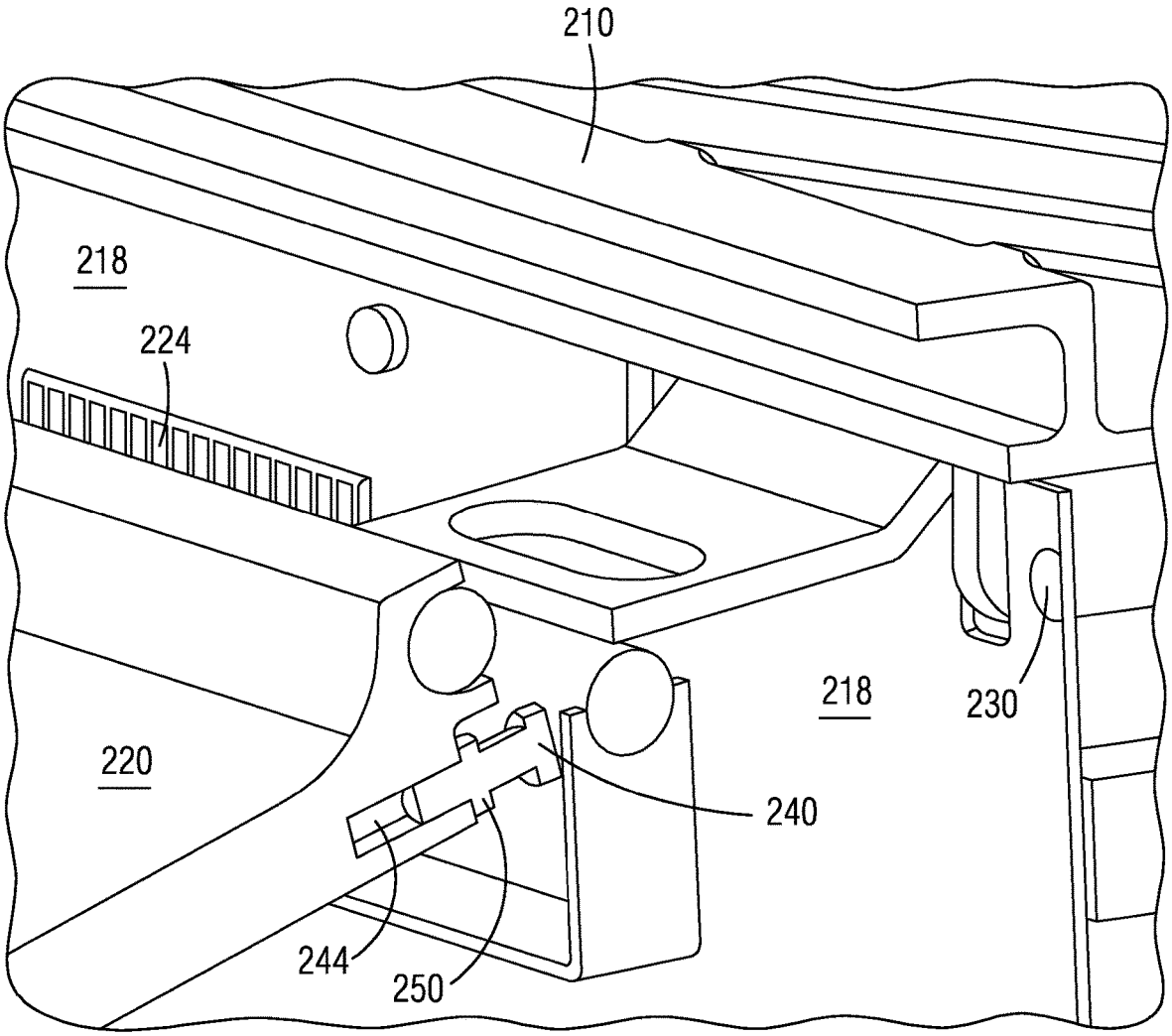
FIG. 7 illustrates a perspective view of a section of crossing gate mechanism in accordance with an exemplary embodiment of the present disclosure.

FIG. 7 illustrates a perspective view of a section of crossing gate mechanism 200 of the embodiment shown in FIG. 4 in accordance with an exemplary embodiment of the present disclosure.

With respect to FIG. 7, portions of the housing 210 and cover 220 are shown, wherein the cover 220 is in a nearly closed position. The computing platform 218, which is part of the control unit 216 (see FIG. 1), comprises the sensing device 230, e.g. Hall sensor array.

The cover 220 comprises mounting hole 244 with inserted magnetized device 240, e.g. magnetized bolt, and nut 250. Magnetized device 240, mounting hole 244 and nut 250 are illustrated in cross section. A predefined distance from a face (end) of the magnetized device/bolt 240 to a surface of the computing platform 218 and thus the sensing device 230 integrated into the computing platform 218 is set, and the nut 250 is tightened to act as a jam nut to hold a position of the magnetized device/bolt 240.

The threaded mounting hole 244 is designed such that the magnetized device 240 is adjustable and/or that different sizes/lengths of devices/bolts 240 can be mounted. That means that the mounting hole 244 is larger than the device 240. A proximity of the device/bolt 240 to the at least one sensing device 230 is adjustable, by moving (adjusting) the magnetized device 240 within the mounting hole 244.

The sensing device 230, configured as Hall sensor array covers a predetermined area. The predetermined area is great enough to allow for different magnetized devices 240 and/or for more vertical and horizontal casting, machining and assembly variations and still ensures that the magnetized bolt 240 is within range of the target area of the sensor 230.

Figure 8:
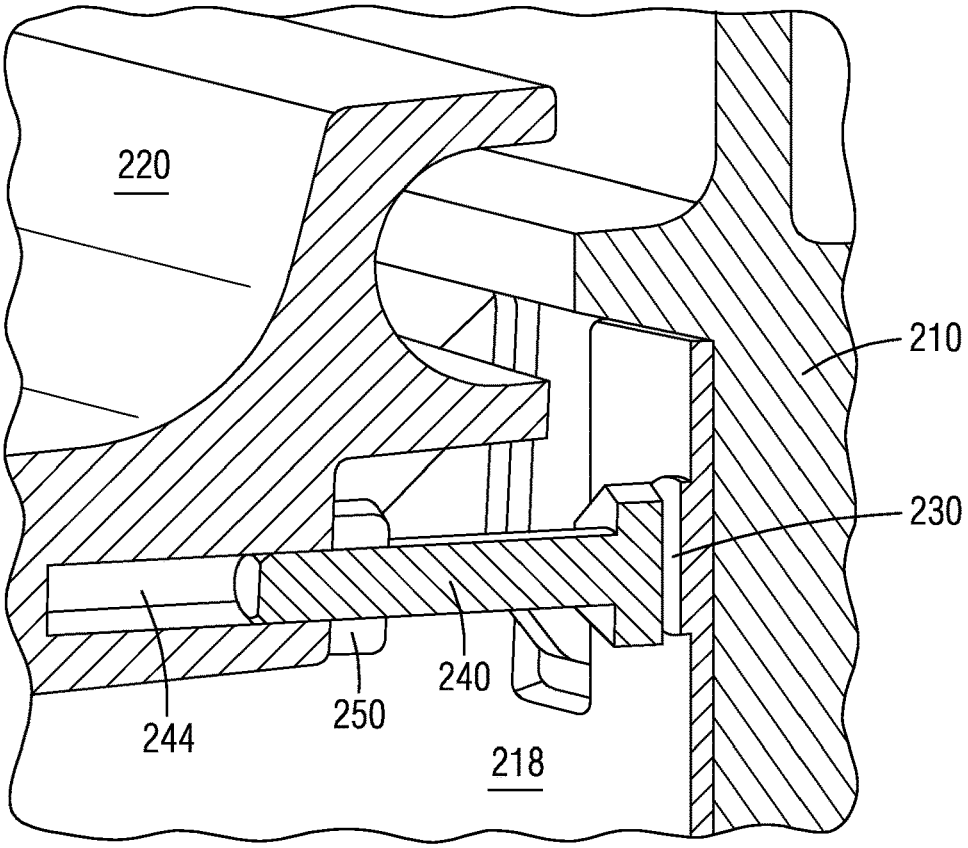
FIG. 8 illustrates another perspective view of a section of crossing gate mechanism in accordance with an exemplary embodiment of the present disclosure.

FIG. 8 illustrates another perspective view of a section of crossing gate mechanism 200 of the embodiment shown in FIG. 4 in accordance with an exemplary embodiment of the present disclosure.

Specifically, FIG. 8 illustrates the cover 220 in a closed position. The magnetized device 240 is near the sensing device 230, leaving a slight space between device 240 and sensor 230. When the cover 220 is in the closed position, the sensor 230, e.g. Hall sensor array arranged on computing platform 218, is activated, and indicates that the cover 220 is closed.

Figure 9:
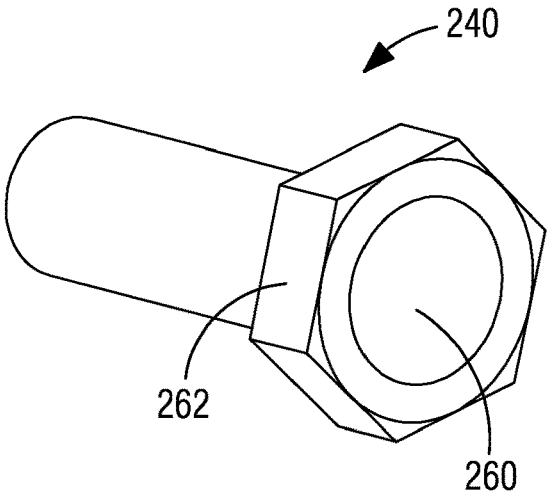
FIG. 9 illustrates a perspective view of a magnetized device in connection with a crossing gate mechanism in accordance with an exemplary embodiment of the present disclosure.

FIG. 9 illustrates a perspective view of magnetized device 240 in connection with a crossing gate mechanism 200 of the embodiment shown in FIG. 4 in accordance with an exemplary embodiment of the present disclosure. Magnetized device 240 is configured as bolt with a magnetized area 260. In an example, the magnetized area 260 is circular and located in head 262 of the bolt. The magnetized area 260 may be a circular magnet inserted into the head 262 of the bolt.

In an embodiment of the present disclosure, the crossing gate mechanism 200, specifically control unit 216 with computing platform 218 and/or the cover detection device 208, is configured to provide, output and/or transmit a signal or notification to other railroad equipment based on the position of the cover 220, for example that the cover 220 is closed or that the cover 220 is open. Based on the indication and output of the cover detection device 208, the control unit 216 or the cover detection device 208 itself provides or generates a signal or notification of the position of the cover 220.

The crossing gate mechanism 200 may have wired or wireless connections and/or communication links to other railroad equipment. For example, the crossing gate mechanism 200 may comprise a transmitter to wirelessly transmit position of the cover 220, such as a 'closed cover signal', to other railroad equipment or to a remote server or remote railway operating center using wireless networks, such as for example wireless LAN (over Internet access point), cellular/mobile network(s) or other radio technology, such as for example via cellular V2X or via standard LTE (3G/4G/5G). In another example, the crossing gate mechanism 200 may transmit a signal or notification to other railroad equipment in close range via Bluetooth®. Such a transmitter may be integrated into the control unit 216 or may be a separate component within the gate mechanism 200.

In another embodiment, the control unit 216 may be configured to turn off the display and/or the LEDs 224 (see FIG. 7) when the cover 220 is in the closed position, to save energy/power of the gate mechanism 200. The control unit 216 may be configured to turn on the display and/or LEDs 224 when the cover 220 is opened. The crossing gate mechanism 200 may comprise an internal display, such as display 224, positioned within the enclosure 204. The internal display 224 may only be visible when the gate mechanism 200 is opened. In another example, the internal display may be visible externally, for example through glass, plexiglass, or similar material, of the enclosure 204. In another embodiment, the crossing gate mechanism 200 may comprise an external display positioned outside the enclosure 204 and for example attached to the enclosure 204.

Further, the gate mechanism 200, utilizing for example the control unit 216, may be configured to maintain the cover 220 in the closed position and disable access to the crossing gate mechanism 200, for example to avoid unauthorized access to the gate mechanism 200. The access may be enabled when a repair or maintenance service is scheduled. Such a disablement/enablement may be activated remotely, for example via Bluetooth® connection.

The described crossing gate mechanism 200 with integrated cover or door detection scheme offers an inexpensive and effective solution for determination and detection of the position of the cover 220. Further, the described gate mechanism 200 provides unauthorized access detection, power savings by turning off display(s) and/or LEDs 224 when the cover 220 is in the closed position, and/or access to the gate mechanism 200 can be disabled/enabled.

Grade crossings including gate mechanisms 200 need to be serviced and maintained, typically by railroad operators. In another exemplary embodiment of the present disclosure, the detection of the position of the cover 220 of the gate mechanism 200 as described herein may be used for logging purposes. For example, the control unit 216 or computing platform 218 of the gate mechanism 200 may comprise a logging system that records or logs each time the gate mechanism 200 is opened and/or closed, utilizing the cover detection device 208. Alternatively, the logging system is externally housed on another computing platform or control unit, wherein a signal or notification is sent by the gate mechanism 200 to the external logging system for recording purposes. The respective computing platform or logging system may use a timestamp of an opening and/or closing of the mechanism 200 to schedule future maintenance or inspection services. Additionally, the logging of the opening/closing of the gate mechanism 200 may be used to confirm maintenance records where the mechanism 200 was recorded as inspected/maintained erroneously because the cover 220 was not opened.

In another embodiment of the present disclosure, the crossing gate mechanism 200 is configured to utilize knowledge of the enclosure 204 being open, i.e., the cover/door 220 is not closed, utilizing the cover detection device 208, to illuminate an exterior indicator light on the enclosure 204, either on the base 210 or on the cover 220, for passing trains to see. Such an exterior indicator light can be on steady or flashing or pulsing in case that the mechanism 200 is not closed/locked properly. Thus, a visual indication is created for train operators/personnel to check and examine crossing gate mechanisms 200 when the exterior light is on or flashing. Typically, during maintenance or service of a grade crossing, train operators/personnel check various equipment, such as crossing bungalow lights, for any failure or malfunction, wherein the proposed exterior indicator light on the gate mechanism 200 can be another item/indicator to be checked.

In another embodiment, the crossing gate mechanism 200, utilizing the cover detection device 208, is configured to utilize the open position of the cover 220 to drive a work light, i.e., a light bulb or LED within the enclosure 204 to help see inside the enclosure 204, for example at night or in poorly lit conditions.

Further, with reference to FIG. 2, the internal components of the gate mechanism 200 have moving parts, such as gearing 212. To prevent maintenance personnel/maintainer from being injured, if the enclosure 204 is open and the gate, e.g., gate arm, is in motion, the mechanism 200 is configured to stop, or to stop and lock, the gate to prevent movement of the gate arm until the maintainer permits movement again, for example via a switch or setting on the computing platform 218 to override such a locking mechanism. In another embodiment, if the enclosure 204 is open and the gate in motion, the gate mechanism 200 can be configured to slow down the movement of the gate, or to change speed of the gate to slow down the moving parts, i.e., motor 214 and gearing 212.

In another embodiment, the crossing gate mechanism 200 further comprises an audible alert, wherein the audible alert is activated in response to a position of the cover 220. The audible alert may be either positive or negative in nature. For example, a proper closing of the cover 220, utilizing the cover detection device, may induce a 'victory' or 'trumpet' sound indicating a successful closure. A negative alert may be that the enclosure 204 is detected to be closed, but the gate mechanism 200 is disabled, or not configured, or comprises an error, etc. Basically, the audible alert is to notify or alert a maintainer (service personnel) to confirm that the gate mechanism 200 is working and the enclosure 204 is closed properly.

Figure 10:
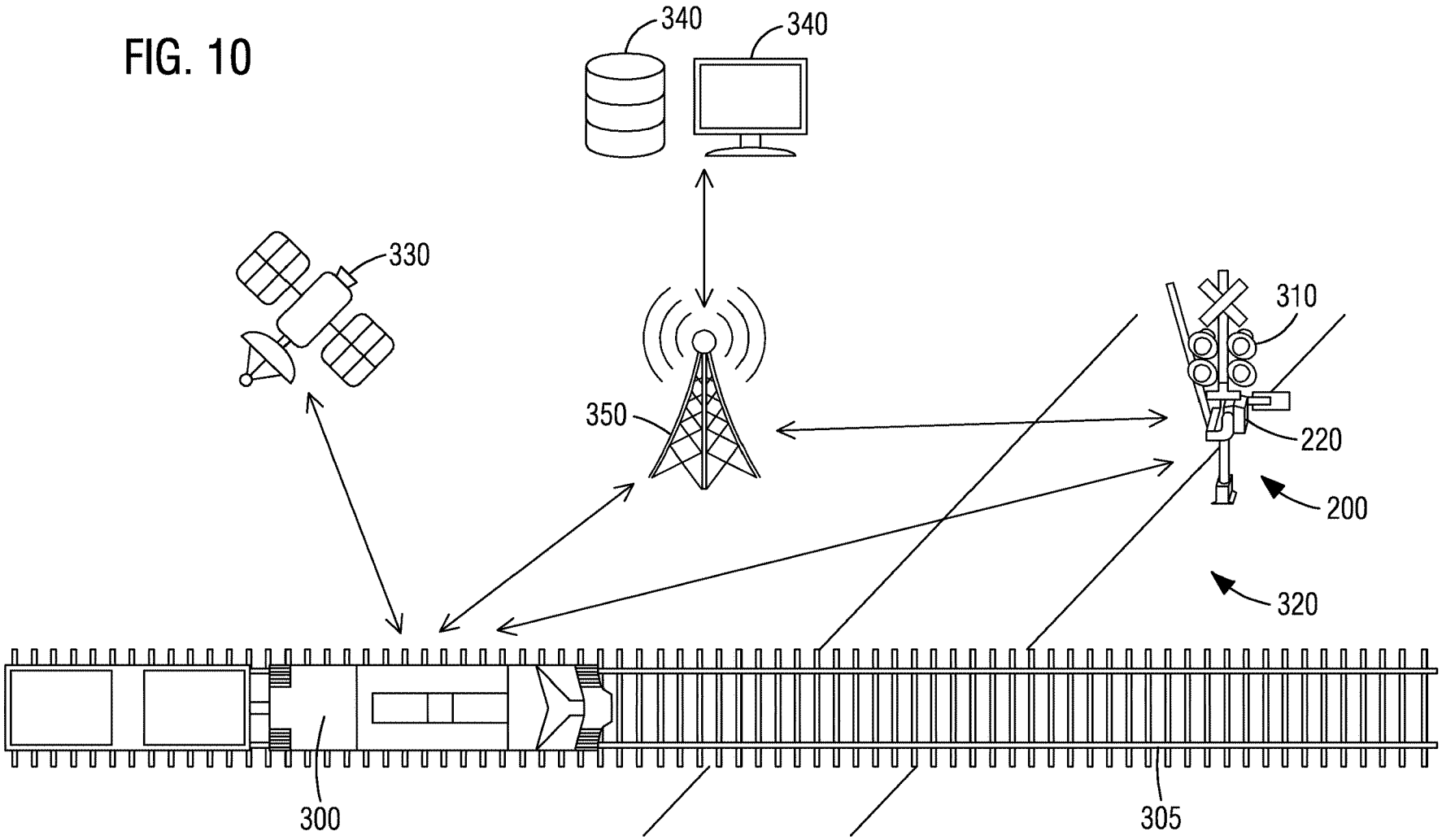
FIG. 10 illustrates a schematic of a train control system, for example positive train control (PTC) system or enhanced train control (ETC) system, in accordance with an exemplary embodiment of the present disclosure.

FIG. 10 illustrates a schematic of a train control system, for example a positive train control (PTC) system or an enhanced train control (ETC) system, and a crossing gate mechanism in accordance with an exemplary embodiment of the present disclosure.

Train control systems, such as PTC systems or ETC systems, are automatic train protection systems that are generally designed to prevent train-to-train collisions, over-speed derailments, incursions into established work zones and movements of trains through switches left in a wrong position. Within a train control system as illustrated in FIG. 10, multiple components communicate and interact with each other, such as an onboard system of train 300, wayside signal system 310, and back-office server (BOS) system 340. Train 300, wayside signal system 310 and BOS system 340 communicate via communication networks (wired and wireless) including network base station 350. The BOS system 340 is a storehouse for speed restrictions, track geometry and wayside signaling configuration databases. A computer-aided dispatching system interacts with the BOS system 340 to enforce the train's 300 authorization to occupy designated segments of track 305. The computer-aided dispatching system communicates via network base station 350 with train 300 and wayside signal system 310.

Further, the onboard system of the train 300 comprises a global position system (GPS) receiver in communication with GPS 330. Speed and location of train 300 is tracked through a combination of GPS 330, the onboard system of the train 300 and radio equipment installed along the railway wayside and reported back to the BOS system 340 by the train 300. For example, when the train 300 is running at a speed or in an area where the train 300 should not be, a warning signal is first sent to an engineer of the train 300. If the engineer does not respond, the train 300 brakes automatically.

In yet another embodiment of the present disclosure, the position of the cover 220 in connection with the cover detection device 208, specifically an open position of the cover 220, may be utilized in connection with the train control system.

For example, when the gate mechanism 200 is open, i.e., cover 220 not closed, a train control bulletin or information is established for the respective grade crossing 320 where the crossing mechanism 200 is located. An oncoming train, such as the train 300, is notified, via communication network between wayside signal system 310, BOS system 340 and onboard system of train 300, that the crossing 320 may be under maintenance, and the train 300 may need to slow down, or stop at the crossing 320. In another example, the open position of the cover 220 of the mechanism 200 may be utilized to automatically create a train control work zone at the respective crossing 320. When the mechanism 200 is closed again, the closed position of the cover 220 can then be used as a precondition to remove the work zone that covers the crossing 320.

A crossing, such as the grade crossing 320, may be monitored by a video monitoring system or other type of monitoring system. If there is a video monitoring system at or near the crossing 320, the detection of activity, either opening or closing of the gate mechanism 200 via cover detection device 208, may be used as a method to engage the video monitoring system to record or document unauthorized tampering with the gate mechanism 200.

The invention claimed is:

1. A crossing gate mechanism comprising:

an enclosure housing multiple components including a control unit configured to operate the crossing gate mechanism and associated crossing gate arm, wherein the enclosure comprises a base and a cover, the cover being moveable between multiple positions including an open position and a closed position, and a cover detection device configured to detect a position of the cover including the open position and the closed position, wherein the cover detection device includes a Hall sensor array arranged on a computing platform of the control unit and a magnetized device comprising a magnetized bolt arranged in the cover.

2. The crossing gate mechanism of claim 1, wherein the control unit or the cover detection device is configured to output a signal or notification based on the position of the cover.

3. The crossing gate mechanism of claim 1, wherein the cover detection device is arranged solely on the cover, or solely on the base, or on a combination of the cover and the base.

4. The crossing gate mechanism of claim 1, comprising multiple cover detection devices configured to detect the position of the cover.

5. The crossing gate mechanism of claim 4, wherein the multiple cover detection devices are arranged on the cover, the base, or a combination of the cover and the base.

6. The crossing gate mechanism of claim 1, wherein the control unit comprises a computing platform, and wherein the cover detection device is configured to be sensed by or communicate with the computing platform.

7. The crossing gate mechanism of claim 6, wherein the cover detection device is arranged on the computing platform of the control unit.

8. The crossing gate mechanism of claim 1, wherein the control unit or the cover detection device is configured to communicate within a network.

9. The crossing gate mechanism of claim 1, further comprising:

a display coupled to the control unit, wherein the control unit is configured to turn off the display when the cover is in the closed position, and wherein the control unit is configured to turn on the display when the cover is in the open position.

10. The crossing gate mechanism of claim 9, wherein the display is an internal display positioned within the enclosure.

11. The crossing gate mechanism of claim 9, wherein the display is an external display positioned outside on the enclosure.

12. The crossing gate mechanism of claim 1, wherein the control unit or the cover detection device is configured to communicate within a train control network including a train control system, and wherein the cover detection device and/or the control unit is configured to generate and output a signal or notification based on the position of the cover.

13. The crossing gate mechanism of claim 12, wherein the train control system is configured to output an action in response to the signal or notification based on the position of the cover.

14. The crossing gate mechanism of claim 13, wherein the action of the train control system comprises a creation, modification, or removal of a bulletin.

15. The crossing gate mechanism of claim 13, wherein the action of the train control system comprises a creation, modification, or removal of a work zone.

16. The crossing gate mechanism of claim 1, wherein the control unit is configured to disable and enable access to the crossing gate mechanism based on the position of the cover.

17. The crossing gate mechanism of claim 1, further comprising:

an exterior indicator arranged on an outside of the enclosure, wherein the exterior indicator is configured to indicate the position of the cover.

18. The crossing gate mechanism of claim 1, further comprising:

an interior light arranged within the enclosure, wherein the interior light is on when the cover is in the open position.

19. The crossing gate mechanism of claim 1, further comprising:

a locking mechanism configured to
stop movement of the crossing gate arm, or
stop movement and lock the crossing gate arm, wherein the locking mechanism is activated when the cover is in the open position and the crossing gate arm is in motion.

20. The crossing gate mechanism of claim 1, further comprising:

a logging system configured to record the position of the cover of the crossing gate mechanism utilizing the cover detection device.

* * * * *